US008463530B2

(12) United States Patent
Müller et al.

(10) Patent No.: US 8,463,530 B2
(45) Date of Patent: Jun. 11, 2013

(54) METHOD FOR OPERATING AUTO IGNITION COMBUSTION ENGINE

(75) Inventors: Karl Müller, Hannover (DE); Bertrand Varoquie, Eaunes (FR)

(73) Assignee: Continental Automotive GmbH, Hannover (DE)

( * ) Notice: Subject to any disclaimer, the term of this patent is extended or adjusted under 35 U.S.C. 154(b) by 852 days.

(21) Appl. No.: 12/625,656

(22) Filed: Nov. 25, 2009

(65) Prior Publication Data

US 2010/0131171 A1 May 27, 2010

(30) Foreign Application Priority Data

Nov. 27, 2008 (EP) ..... 08020648

(51) Int. Cl.
*F02D 41/30* (2006.01)
*F02D 41/14* (2006.01)

(52) U.S. Cl.
USPC ..... 701/105; 701/102; 701/103; 701/104

(58) Field of Classification Search
USPC ..... 701/101, 102, 103, 104, 105; 123/478
See application file for complete search history.

(56) References Cited

U.S. PATENT DOCUMENTS

| | | | | |
|---|---|---|---|---|
| 7,213,565 | B2 * | 5/2007 | Grunaug et al. | 123/299 |
| 7,213,566 | B1 | 5/2007 | Jankovic | 123/302 |
| 7,729,845 | B2 * | 6/2010 | Iwashita et al. | 701/104 |
| 2004/0025849 | A1 * | 2/2004 | West et al. | 123/480 |
| 2005/0224044 | A1 * | 10/2005 | Stojkovic et al. | 123/299 |
| 2005/0229903 | A1 * | 10/2005 | Kobayashi et al. | 123/435 |
| 2006/0107921 | A1 * | 5/2006 | Grunaug et al. | 123/299 |
| 2006/0196469 | A1 * | 9/2006 | Kuo et al. | 123/305 |
| 2007/0089704 | A1 | 4/2007 | Jacobsson et al. | 123/299 |
| 2008/0221780 | A1 | 9/2008 | Ishikawa | 701/104 |
| 2009/0043482 | A1 * | 2/2009 | Speetzen et al. | 701/103 |
| 2009/0090107 | A1 * | 4/2009 | Youssef et al. | 60/602 |
| 2009/0164089 | A1 * | 6/2009 | Youssef et al. | 701/102 |
| 2009/0216427 | A1 * | 8/2009 | Yamakawa et al. | 701/103 |
| 2009/0259385 | A1 * | 10/2009 | Loeffler et al. | 701/102 |
| 2010/0116249 | A1 * | 5/2010 | Guerrassi et al. | 123/435 |
| 2011/0106388 | A1 * | 5/2011 | Boeckenhoff et al. | 701/70 |
| 2011/0106390 | A1 * | 5/2011 | Post et al. | 701/84 |

FOREIGN PATENT DOCUMENTS

| | | |
|---|---|---|
| EP | 1785616 | 5/2007 |
| EP | 1803918 | 7/2007 |

OTHER PUBLICATIONS

European Search Report and Written Opinion for Application No. 08020648.5 (5 pages), Apr. 28, 2009.

* cited by examiner

*Primary Examiner* — Stephen K Cronin
*Assistant Examiner* — Arnold Castro
(74) *Attorney, Agent, or Firm* — King & Spalding L.L.P.

(57) ABSTRACT

A low computation method for operating auto ignition combustion engines, in which outputs, in particular a requested torque set point TQI_SP is directly linked to an injected fuel mass flow distribution, to the EGR rate and the air control by taking into account engine out emissions & drivability constrains by using a multi-objective optimization method. A method to monitor in the embedded controller the indicated torque, TQI is also proposed.

16 Claims, 4 Drawing Sheets

METHOD FOR OPERATING AUTO IGNITION COMBUSTION ENGINE

CROSS-REFERENCE TO RELATED APPLICATIONS

This application claims priority to EP Patent Application No. 08020648 filed Nov. 27, 2008, the contents of which is incorporated herein by reference in its entirety.

TECHNICAL FIELD

The invention relates to a low computation method for operating auto ignition combustion engines, in which outputs, in particular the requested torque set point TQI_SP and/or an estimation of a torque realization TQI, are directly linked to an injected fuel mass flow distribution and to an injection timing by taking into account engine out emissions, the air path control & drivability constraints by using a multi-objective optimization method. A method to monitor in the embedded controller the indicated torque, TQI is also proposed.

BACKGROUND

In order to be able to satisfy increasingly strictly conceived emission limits, while simultaneously providing high outputs, such as high driving torques in a motor vehicle, improved management systems for more efficient operation of the internal combustion engine are also continuously required in relation to internal combustion engines, in particular in the field of motoring. The relationships between requested torque TQI_SP, start of a fuel injection SOI, duration of a fuel injection TI, the number of injections and injected fuel quantity MF in particular play a crucial role in the engine operating point definition which is a compromised between reduced engine out emissions target, such as the Euro 6 emission standards for diesel combustion engines, and the best fuel conversion for torque production. The values of the above-mentioned parameters must be constantly updated and processed during the operation of the vehicle, requiring computing power and computing time.

SUMMARY

According to various embodiments, a generic internal combustion engines may be able to operate more efficiently and with less computing time.

According to an embodiment, in a method for operating auto ignition combustion engines, outputs, in particular a requested torque set point TQI_SP and/or an estimation of a torque realization TQI, are directly linked to an injected fuel mass flow distribution and to an injection timing by taking into account engine out emissions and/or drivability constraints by using an optimization method.

According to a further embodiment, the torque realization set point directly linked to an injected fuel mass flow distribution and to an injection timing may be optimized by taking into account engine out emissions and/or drivability constraints. According to a further embodiment, the indicated torque realization used for torque production monitoring can be $TQI=\eta*30*LHV*MF/(N*\pi)$, where MF is the fuel mass injected per combustion cycle [g/stroke] dedicated to torque production, where LHV is the fuel combustion lowest heating value [J/g], where N is the engine speed and where $\eta$ is the global fuel to torque conversion efficiency. According to a further embodiment, the global fuel to torque conversion efficiency $\eta$ may be given by the product of the combustion efficiency $\eta_{comb}$ ad of the engine mechanical efficiency $\eta_{mech}$, with $\eta=\eta_{comb}*\eta_{mech}$. According to a further embodiment, an overall fuel mass injected in a combustion chamber for lean combustion can be burnt during the auto-ignition process if the start of injections SOI are calibrated to compensate the injector response, the auto ignition delay and the EGR effect on the auto ignition delay, ideally thus the combustion efficiency variation $\eta_{comb}$ can be ignored and fixed to $\eta_{comb}=1$, at least for a selected SOI bandwidth that respects engine out emission constrains. According to a further embodiment, a mechanical efficiency $\eta_{mech}$ can be used in an embedded software as a 2D look up table depending both on the engine speed N and the engine cooling temperature TCO, $\eta_{mech}=\eta_{mech}(N, TCO)$. According to a further embodiment, a global equivalence ratio $\Phi=(MF/MA)/(MF/MA)_{stoich}=(MF/MA)*\alpha_{stoich}$ can be used to adapt the air mass flow via the air path control and turbocharger position control because MA the air mass flow can be continuously measured on modern engine management systems and MF is known by in the embedded software. According to a further embodiment, the realisation of the indicated torque set point TQI_SP can be done considering several constrains, whereas these constrains are:

- maximum indicated torque production (unit Nm);
- minimum noise ie slower increase of the in-cylinder pressure (unit DbA or $bar.s^{-1}$);
- minimum emission of Nitrous oxides [NOx];
- minimum emission of Soot [Soot];
- minimum emission of carbon monoxide [CO];
- minimum emission of unburnt hydrocarbons [HC]; and/or
- minimum fuel consumption and hence minimum carbon monoxide emission [CO2], where [i] is the emission of a specie i in g/stroke or g/km.

According to a further embodiment, optimized realization TQI_SP may be found by minimizing the error of a multi-objective function J for the overall engine operating points, with $$J=W_{TQI_SP}*TQI_SP/TQI_SP^{ref}+W_{soot}*[Soot]/[Soot]^{ref}+W_{nox}*[Nox]/[Nox]^{ref}+W_{co2}*[CO2]/[CO2]^{ref}+W_{HC}*[HC]/[HC]^{ref}+W_{CO}*[CO]/[CO]^{ref}+W_{noise}*[Noise]/[Noise]^{ref}$$

and where:

- $TQI_SP^{ref}$ is the targeted indicated torque in Nm;
- $[Soot]^{ref}$ is the targeted soot emission value in g/stroke or g/km;
- $[Nox]^{ref}$ is the targeted nitrogen oxides emission value in g/stroke or g/km;
- $[CO2]^{ref}$ is the targeted carbon dioxide emission value in g/stroke or g/km;
- $[HC]^{ref}$ is the targeted unburnt hydrocarbons emission value in g/stroke or g/km;
- $[CO]^{ref}$ is the targeted carbon monoxide emission value in g/stroke or g/km;
- $[Noise]^{ref}$ is the targeted noise limitation in DbA or bar/s; and/or
- $W_k$ is a weight proportional to the importance of an objective k relative to the others. For example, if the CO2 emission constrains should be rigorously respected, $W_{CO2}$ should be more important than the other weights by respecting $\Sigma_k W_k=1$.

According to a further embodiment, an engine actuator used to minimize an error of a multi-objective function J for each operating point in the case of modern EMS dedicated to auto ignition engine control may be:

The number of injection $Nb_{inj}$ par combustion cycle, $1 \leqq i \leqq Nb_{inj}$ where i is an index for different fuel injections relating to a large number of fuel injection patterns, such as i=1 for a first pre-injection, i=2 for a second pre-injection, etc.;

The quantities injected per elementary injection $MF^i$ with $\Sigma_i MF^i = MF$;

The start of injection $SOI^i$ perelementary injection;

The air path control by the way of the global equivalence ratio Φ because in our case the measured air mass flow, MA, is linked to injected mass flow MF by $\Phi = (MF/MA)*\alpha_{stoich}$. The global equivalence ratio Φ is set according to the engine load targets and the turbocharger air mass flow limitation for a given operating point; and/or The EGR rate, $X_{EGR}$=[burnt gases]./[fresh gases] defined as the ratio between burnt gases and fresh gases in the intake manifold.

11. The method as claimed in any one of the preceding claims, characterized in that embedded maps for the torque realization TOI related to an engine actuators control according to the aforementioned constrains are then reduced to:

A 2D look up table with a dependence in N and TQI_SP for $Nb_{inj}$, the number of injection request per combustion cycle;

A 2D look up table with a dependence in N and TQI_SP for $MF^i$, the injected fuel mass request for each elementary injection i and per combustion cycle;

A 2D look up table with dependence in N and TQI_SP for $SOI^i$, the start of injection request for each elementary injection and per combustion cycle;

A 2D look up table with dependence in N and TQI_SP for Φ, the global equivalence ratio request per combustion cycle; and/or A 2D look up table with dependence in N and TQI_SP for the EGR rate request per combustion cycle.

BRIEF DESCRIPTION OF THE DRAWINGS

Further advantages, aims and properties of the present invention will be described with reference to the following description of the appended drawings.

In the drawings.

DETAILED DESCRIPTION

According to various embodiments, in a method for operating auto ignition combustion engines, outputs, in particular a requested torque set point TQI_SP and an estimation of the torque realization TQI, are directly linked to an injected fuel mass flow distribution and to an injection timing by taking into account engine out emissions and/or drivability constraints by using an optimization method.

Operation of an internal combustion engine, in particular auto ignition combustion engines, the combustion management system can in particular also be simplified if the main focus is the torque realization set point. If the engine out emission and/or for example noise reduction constraints are introduced the complexity of the control appears because of the number of degrees of freedom due to the possibility to have several injections per combustion cycle.

The method proposed here to manage auto ignition engines takes into account both the best torque production objective, the engine out emission constrains and the drivability request.

To reach a given operating point, the engine control unit calculates an indicated torque set point TQI_SP, according to the acceleration pedal position PV, the engine speed N and the vehicle speed Vs. In the other hand, the indicated torque realization TQI can also be estimated and compared to the set point TQI_SP [see FIG. 1].

Figure 1:
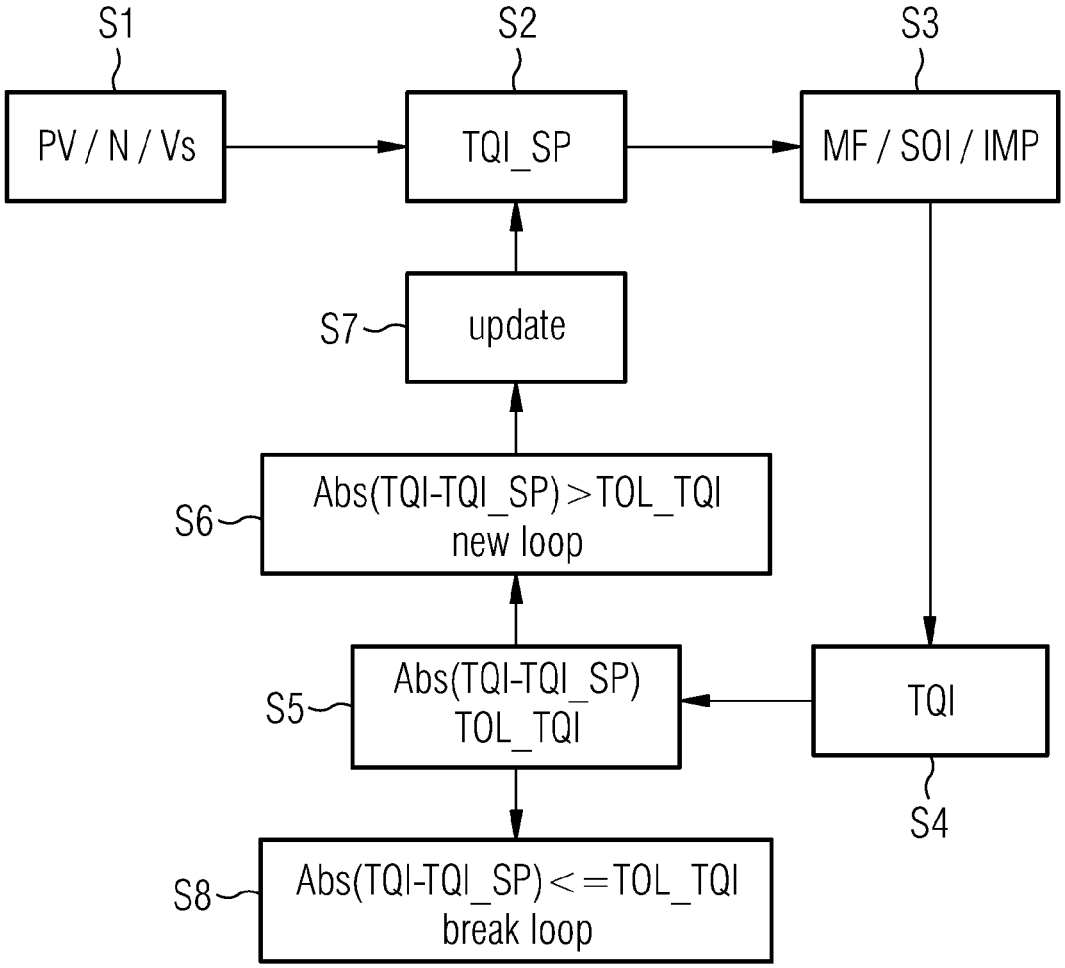
FIG. 1 schematically shows Torque realization diagram according to the operating point definition.

The state of the art of the control algorithms embedded in the engine management unit (ECU) is the ability to reach the torque request set point by acting mainly on the engine actuators such as injectors, EGR valves, turbochargers actuators by minimizing the difference between TQI_SP and TQI. [see FIG. 1].

The estimation of the indicated torque TQI at a given operating point in the embedded software proposed here can be achieved advantageously by $TQI = \eta*30*LHV*MF/(N*\pi)$, where MF is the fuel mass injected per combustion cycle [g/stroke] dedicated to torque production (for example the fuel mass flow used for a particle filter regeneration of is not considered), where LHV is the fuel combustion lowest heating value [J/g], where N is the engine speed and where η is the global fuel to torque conversion efficiency.

The global fuel to torque conversion efficiency η is usually given by the product of the combustion efficiency $\eta_{comb}$ and of the engine mechanical efficiency $\eta_{mech}$, with $\eta = \eta_{comb} * \eta_{mech}$.

Especially for lean combustion an overall fuel mass injected in a combustion chamber is burnt during the auto-ignition process if the starts of injections SOI are calibrated to compensate the injector response and the auto ignition delay. In the same manner the EGR effect on the combustion efficiency is negligible as long as the effect of the ignition delay is compensated by shifting the start of injection SOI. Moreover, the start of injection SOI and the number of injection are tuned to reach the best global fuel conversion efficiency to limit unburned hydrocarbons.

Thus, the combustion efficiency variation $n_{comb}$ advantageously can be ignored and $\eta_{comb}$ can be fixed to 1, $\eta_{comb}=1$, at least for a selected SOI bandwidth correctly pre-calibrated.

The mechanical efficiency $\eta_{mech}$ of the engine is defined by $\eta_{mech} = ((1-P_{friction})(P_{friction}+P_{exh}))$ where $P_{friction}$ designates a loss of power owing to cylinder pumping and friction losses, $P_{exh}$ identifying a loss of power relating to the exhaust in the engine.

The mechanical efficiency $\eta_{mech}$ can be easily determined on an engine test bench according to the engine speed N by measuring the torque at clutch and the energy sent to the exhaust line for different engine cooling temperature TCO. So $\eta_{mech} = \eta_{mech}$ (N, TCO). The mechanical efficiency $\eta_{mech}$ appears ideally in the embedded software preferably as a 2D look up table depending both on the engine speed N and the engine cooling temperature TCO [see FIG. 2].

Finally calculation used to monitor the TQI in the embedded software is given by $TQI = (\eta, TCO)*30*LHV*MF/[N*\pi]$ and leads to reduced level of computing power.

At the same time, the global equivalence ratio $\Phi = (MF/MA)/(MF/MA)_{stoich} = (MF/MA)*\alpha_{stoich}$ can be calculated online because the air mass flow MA is continuously measured on modern engine management systems. The global equivalence ratio Φ gives information if the combustion is lean Φ<1, stoichiometric Φ=1 or rich Φ>1. Φ>1 never appears on auto-ignition engines because of the lean combustion mode specification.

The indicated torque set point TQI_SP has to be now defined according to several constraints. These constrains are listing in [List 1]:

[List 1]

- maximum indicated torque production (unit Nm);
- minimum noise ie slower increase of the in-cylinder pressure (unit DbA or bar.$s^{-1}$);
- minimum emission of nitrogen oxides [NOx];
- minimum emission of Soot [Soot];
- minimum emission of carbon monoxide [CO];
- minimum emission of unburnt hydrocarbons [HC]; and/or
- minimum fuel consumption and hence minimum carbon monoxide emission [CO2], where [i] is the emission of a specie i in g/stroke or g/km.

The indicated torque set point TQI_SP definition derived from a compromise of all of these constraints which can be antagonistic. Moreover, modern engine management systems for autoignition engines can manage up to 6 injections per combustion cycle, this make more complex the tuning that could respect the aforementioned constrains.

- The number of injection $Nb_{inj}$ par combustion cycle. $1 \leqq i \leqq Nb_{inj}$ where i is an index for different fuel injections relating to a large number of fuel injection patterns, such as i=1 for a first pre-injection, i=2 for a second pre-injection, etc.;
- The quantity injected per elementary injection $MF^i$ [FIG. 3] and $\Sigma_i MF^i = MF$;
- The start of injection per elementary injection $SOI^i$;
- The air path control by the way of the global equivalence ratio Φ because in our case the measured air mass flow, MA, is linked to injected mass flow MF by $\Phi = (MF/MA) * \alpha_{stoich}$. The global equivalence ratio Φ is set according to the engine load targets and the turbo-charger air mass flow limitation for a given operating point; and/or
- The EGR rate, $X_{EGR}$=[burnt gases]./[fresh gases] defined as the ratio between burnt gases and fresh gases in the intake manifold. The exhaust gas recirculation, EGR, is used to decrease the NOX emissions.

These key parameters are linked to the engine actuators such like injectors, EGR valve, variable geometry turbine command, etc . . .

So the TQI_SP at a given operating point with tuned engine actuators is found by minimizing the multi-objective error J over several realizations considering constrains fixed by the operator.

TABLE 1

| Operating point | Objectives to reach ↕ Minimising J | | | | | | Constrains on operating points | | | | |
|---|---|---|---|---|---|---|---|---|---|---|---|
| definition N | $TQI_SP_{ref}$ N · m | $[SOOT]_{ref}$ mg/stk | $[CO]_{ref}$ mg/stk | $[CO2]_{ref}$ mg/stk | $[NO]_{ref}$ mg/stk | $[NOISE]_{ref}$ Db(A) | MF mg/stk | $Nb_{ij}$ | SOI min/max | EGR % | φ |
| 2500 | 100 | 5 | 13 | 80 | 1 | 80 | 30 | 3 | −30°/10° | 10 | 0.6 |
| 2500 | 200 | 8 | 20 | 100 | 3 | 80 | 40 | 2 | −30°/10° | 0 | 0.7 |
| Etc . . . | . . . | . . . | . . . | . . . | . . . | . . . | . . . | . . . | . . . | . . . | . . . |

The method presented allows to specify the indicated torque set point TQI_SP by specifying the number of injection $Nb_{inj}$, the injected quantity per elementary injection $MF^i$, the elementary start of injection $SOI^i$, the EGR rate and the global equivalence ratio to respect above constrains.

Target values for each constrains are noted with the superscript$^{ref}$.

So the best way to achieve TQI_SP is considering constrains listed in [list 1] by minimizing the error of a multi-objective function that depends on $TQI_SP^{ref}$, $[Soot]^{ref}$, $[Nox]^{ref}$, $[CO2]^{ref}$, $[CO]^{ref}$, $[Noise]^{ref}$.

The error $E_k$ on an objective k according to the reference value is calculated by $E_k = k/k^{ref}$. Depending on the importance of an objective relative to the others, a weight $W_k$ is introduced. For example, if the CO2 emission constrains should be rigorously respected, $W_{CO2}$ should be more important than the other weights by respecting $\Sigma_k W_k = 1$.

The best TQI_SP taking into the overall objectives is found by minimizing the multi-objective error J, J is given by $J = \Sigma_k W_k E_k$. Considering objectives listed in [list 1]. J can be rewrite like:

$$J = W_{TQI_SP} * TQI_SP/TQI_SP^{ref} + W_{soot} * [Soot]/[Soot]^{ref} + W_{nox} * [Nox]/[Nox]^{ref} + W_{co2} * [CO2]/[CO2]^{ref} + W_{HC} * [HC]/[HC]^{ref} + W_{CO} * [CO]/[CO]^{ref} + W_{noise} * [Noise]/[Noise]^{ref}$$

The liberty degrees to find the best TQI_SP at a given operating point are in the case of modern EMS dedicated to auto ignition engine control:

The realizations can be done experimentally on engine test benches or by means of 0D/1D/3D simulation tools specially designed for computational engine system development field. This operation must be done for the overall engine speed range ($0 \leqq N \leqq Nmax$) and for the overall indicated torque range ($0 \leqq TQI \leqq TQImax$) of the engine.

Figure 4:
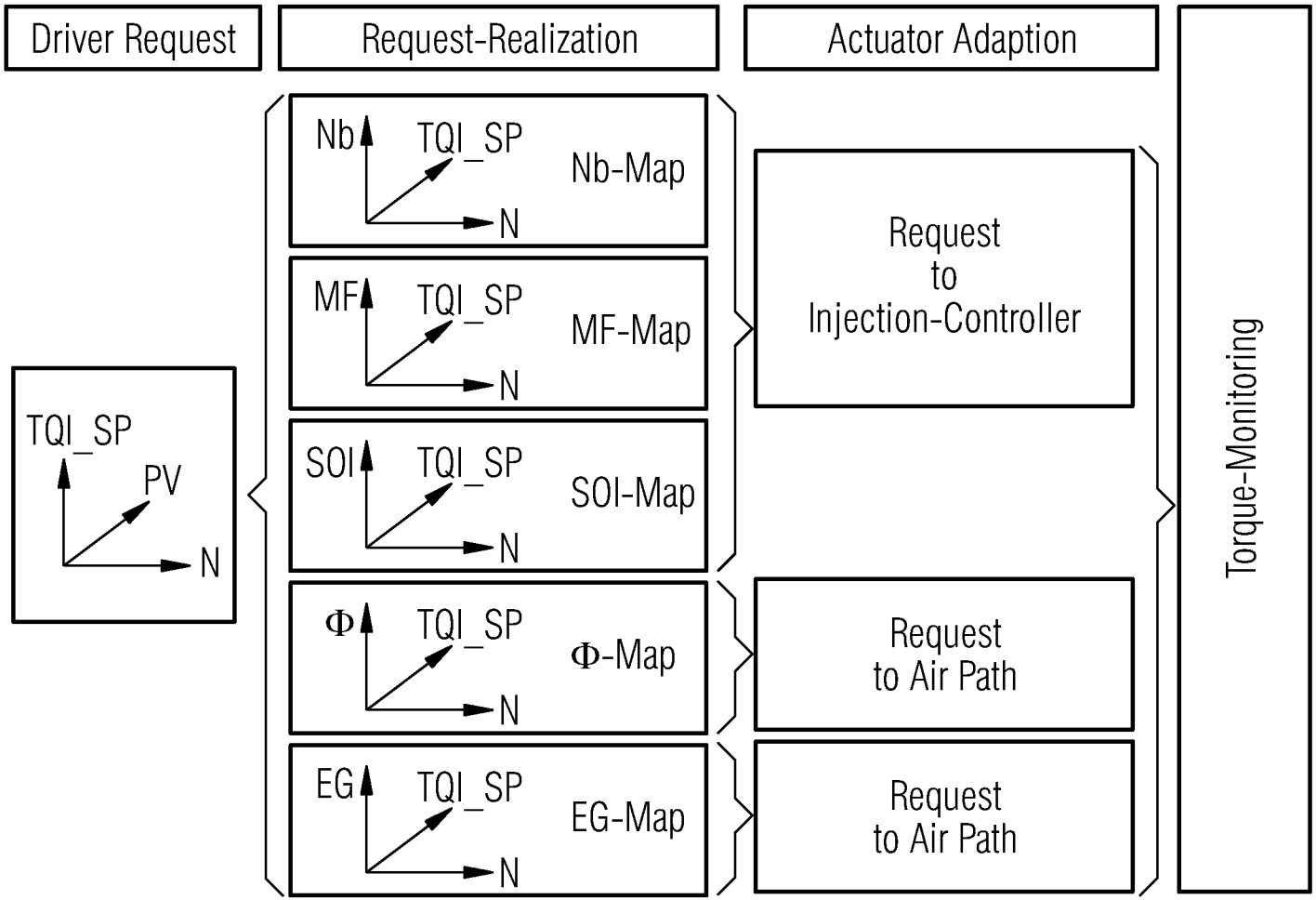
FIG. 4 schematically shows diagram of the proposed engine management system with an optimized realization of TQ_SP according to drivability and engine out consideration.

By using this method to define the indicated torque set point TQI_SP, constraints due to the torque realization and to the engine out emission can be managed by engine control unit (ECU) illustrated by the realization diagram illustrated on FIG. 4. The engine management is then obtained with a reduced CPU time because engine out emission constraints have been already mapped during an offline optimization phase.

The embedded maps for the torque realization acting the engine actuators according to the aforementioned constraints are then reduced to:

- A 2D look up table for $Nb_{inj}$, the number of injection request per combustion cycle as a function of N and TQI_SP;
- A 2D look up table for $MF^i$, the injected fuel mass request for each elementary injection i and per combustion cycle as a function of N and TQI_SP;
- A 2D look up table for $SOI^i$, the start of injection request for each elementary injection and per combustion cycle as a function of N and TQI_SP;

A 2D look up table for Φ, the global equivalence ratio request per combustion cycle as a function of N and TQI_SP; and/or A 2D look up table for the EGR rate request per combustion cycle as a function of N and TQI_SP.

On figure [FIG. 4], TQI_SP is the torque request obtained directly from the acceleration pedal interpretation. Several approaches can be used to obtain TQI_SP but in most approaches, TQI_SP, depends on the acceleration pedal position PV_AC, the engine speed N and the vehicle speed VS. So finally $TQI_SP^{ref}=f(N,PV_AC,VS)$, the shape of the function f can change depending on the vehicle type (sport, tourism, light or heavy duty trucks, etc.) and/or the adaptation to the transient vehicle behavior [FIG. 5].

The torque realization diagram shown in FIG. 1 displays a loop on torque realization TQI. Based on a pedal position PV, an engine speed N and a vehicle speed Vs, shown in step S1, a torque request TQI_SP is requested within step S2, with optimized torque production, pollutant reduction and noise limitation. By taking into account a fuel mass MF, a start of injection SOI and an intake manifold pressure IMP within step S3 an indicated torque estimation TQI take place in step S4. In the following step S5 the indicated torque estimation TQI is tested out. If the indicated torque estimation TQI minus the indicated torque request TQI_SP is less than or equal the needed torque TOL_TQI the loop breaks in step S8. If the indicated torque estimation TQI minus the indicated torque request TQI_SP is more than the needed torque TOL_TQI a new loop start within step S6 and an update of the respective key parameters like injection parameters, air path parameters, etc.

Figure 2:
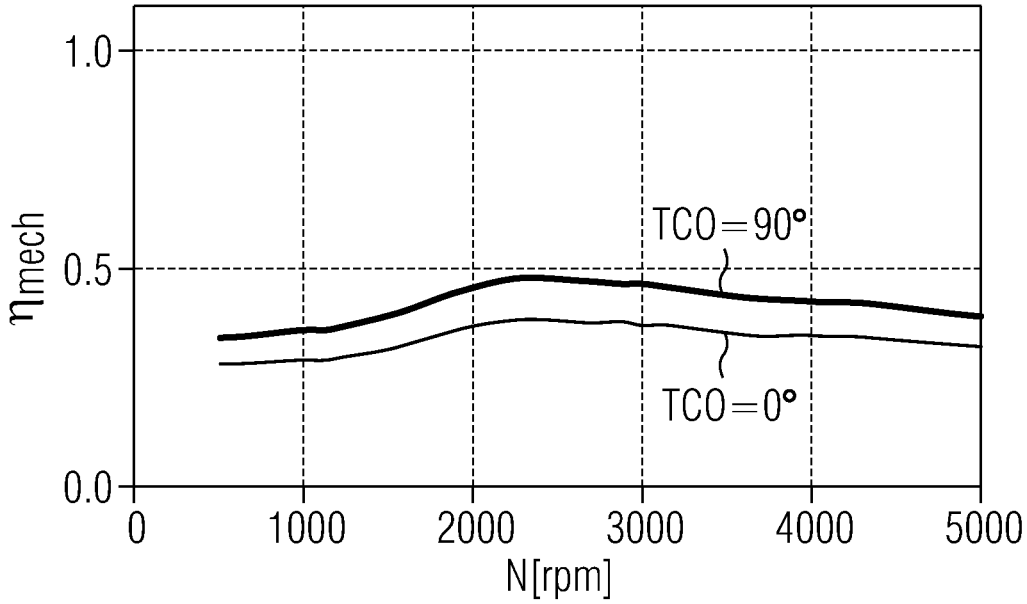
FIG. 2 schematically shows a graph relating to a mechanical efficiency $\eta_{mech}$ as a function of an engine speed N and the cooling temperature TCO.

In the second graph shown in FIG. 2 on the other hand the engine speed N is plotted on the abscissa and corresponding mechanical efficiency $\eta_{mech}$ is plotted on a second ordinate. The speed N and the engine coolant temperature are influencing the mechanical efficiency $\eta_{mech}$.

Figure 3:
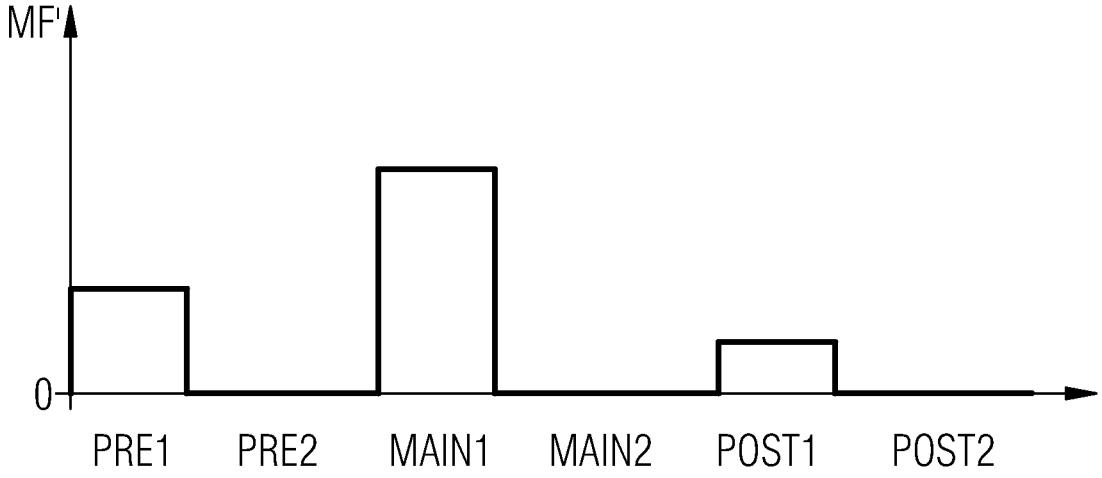
FIG. 3 schematically shows a graph relating to the injection management. The fuel mass flows $MF^i$ relative for an individual fuel injection i per combustion cycle.

The further graph shown in FIG. 3 shows a fuel mass flow distribution $MF^i$ for a multiple injection operating mode.

In the diagram shown in FIG. 4 a choice of maps of the torque request realization according to several constraints are listed. The first map, Nb-Map, contains a look up table of optimized number of injection required per combustion cycle. Another second map, MF-Map, contains a look up table of optimized fuel mass quantity required per injection an combustion cycle. An additional third map, SOI-Map, includes a look up table of optimized start of injection required per injection and combustion cycle. A further fourth map, Φ-Map, describes a look up table of optimized equivalence ratio required per combustion cycle. And a fifth map, EG-Map, shows a look up table of optimized EGR rate required per combustion cycle. That will lead to the torque monitoring according to several constraints.

Figure 5:
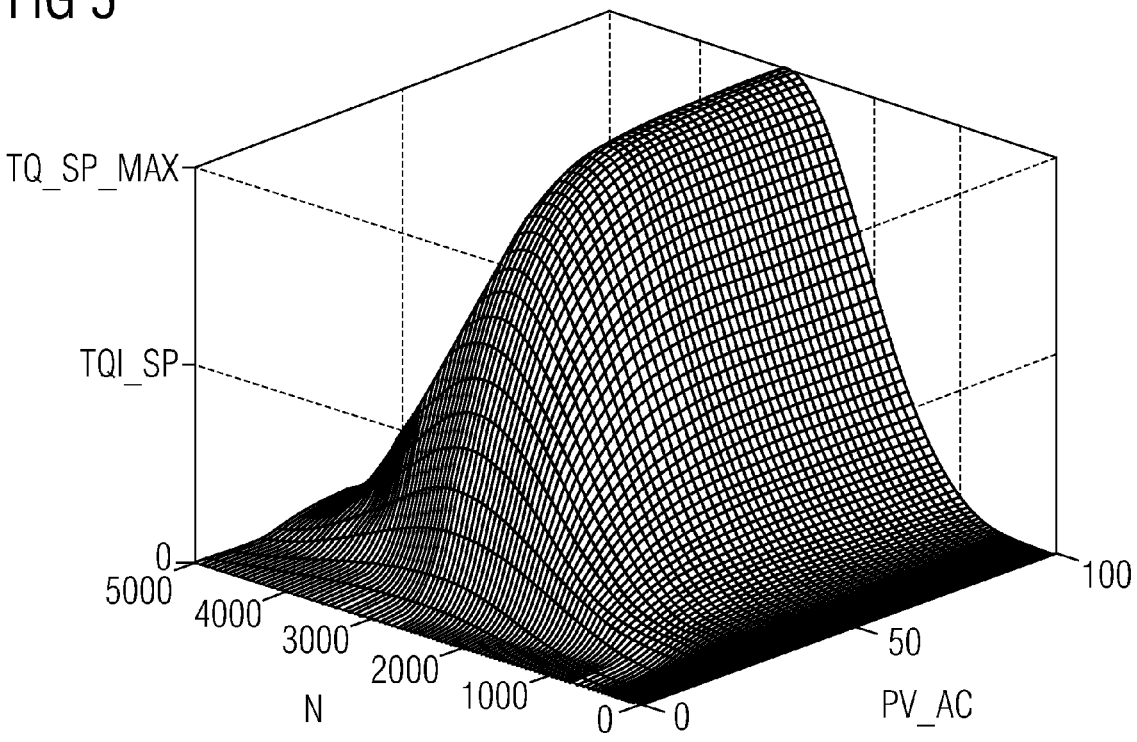
FIG. 5 schematically shows an example of TQ_SP interpretation according to the acceleration pedal PV_AC and the engine speed N at given vehicle speed VS.

The diagram shown in FIG. 5 is an example of TQ_SP interpretation according to the acceleration pedal PV_AC and the engine speed N at given vehicle speed VS, where the TQI_SP is plotted on the ordinate (y-axis). The engine speed N is plotted on the x-axis and the pedal PV_AC is plotted on the z-axis.

What is claimed is:

1. A method for operating auto ignition combustion engines, comprising:

directly linking outputs to an injected fuel mass flow distribution and to an injection timing by taking into account engine out emissions and/or drivability constraints by using an optimization method, determining an optimized torque realization TQI_SP by minimizing an error of a multi-objective function for overall engine operating points, wherein the determined optimized torque realization is implemented by at least one engine actuator configured to control at least one of:

a number of injection $Nb_{inj}$ par combustion cycle, $1 \leqq i \leqq Nb_{inj}$ where i is an index for different fuel injections relating to a large number of fuel injection patterns, such as i =1 for a first pre-injection, i=2 for a second pre-injection, etc.;

quantities injected per elementary injection $MF^i$ with $\Sigma_i MF^i=MF$;

a start of injection $SOI^i$ per elementary injection;

an air path control by the way of the global equivalence ratio Φ because in our case the measured air mass flow, MA, is linked to injected mass flow MF by $\Phi=(MF/MA)*\alpha_{stoich}$;

a global equivalence ratio Φ is set according to the engine load targets and the turbocharger air mass flow limitation for a given operating point; and an EGR rate, $X_{EGR}$=[burnt gases]./[fresh gases] defined as the ratio between burnt gases and fresh gases in the intake manifold.

2. A method for operating auto ignition combustion engines, comprising:

directly linking a requested torque set point TQI SP and an estimation of a torque realization TQI to an injected fuel mass flow distribution and to an injection timing by taking into account engine out emissions and/or drivability constraints by using an optimization method, and calculating by a processor the torque realization TQI as a function of at least (a) MF: a fuel mass injected per combustion cycle [g/stroke] dedicated to torque production, (b) LHV: a fuel combustion lowest heating value [J/g], (c) N: an engine speed, and (d) η: a global fuel to torque conversion efficiency.

3. The method according to claim 2, wherein the torque realization set point directly linked to an injected fuel mass flow distribution and to an injection timing are optimizing by taking into account at least one of engine out emissions and drivability constraints.

4. The method according to claim 2, wherein the indicated torque realization used for torque production monitoring is $TQI=\eta*30*LHV*MF/(N*\pi)$.

5. The method according to claim 4, wherein the global fuel to torque conversion efficiency η is given by the product of the combustion efficiency $\eta_{comb}$ and of the engine mechanical efficiency $\eta_{mech}$, with $\eta=\eta_{comb}*\eta_{mech}$.

6. The method according to claim 2, wherein an overall fuel mass injected in a combustion chamber for lean combustion is burnt during the auto-ignition process if the start of injections SOI are calibrated to compensate the injector response, the auto ignition delay and the EGR effect on the auto ignition delay, such that the combustion efficiency variation $\eta_{comb}$ is ignored and fixed to $\eta_{comb}=1$, at least for a selected SOI bandwidth that respects engine out emission constrains.

7. The method according to claim 2, wherein a mechanical efficiency $\eta_{mech}$ is used in an embedded software as a 2D look up table depending both on the engine speed N and the engine cooling temperature TCO, $\eta_{mech}=\eta_{mech}$ (N, TCO).

8. The method according to claim 2, wherein a global equivalence ratio $\Phi=(MF/MA)/(MF/MA)_{stoich}=(MF/MA)*\alpha_{stoich}$ is used to adapt the air mass flow via the air path control and turbocharger position control.

9. The method according to claim 2, wherein the realisation of the indicated torque set point TQI_SP is done considering several constrains, whereas these constrains are selected from the group consisting of:

maximum indicated torque production (unit Nm);

minimum noise ie slower increase of the in-cylinder pressure (unit DbA or bar.s$^{-1}$);

minimum emission of Nitrous oxides [NOx];

minimum emission of Soot [Soot];

minimum emission of carbon monoxide [CO];

minimum emission of unburnt hydrocarbons [HC]; and minimum fuel consumption and hence minimum carbon monoxide emission [CO2], where [i] is the emission of a specie i in g/stroke or g/km.

10. The method according to claim 2, wherein optimized realization TQI_SP is found by minimizing the error of a multi-objective function J for the overall engine operating points, with $$J=W_{TQI_SP}*TQI_SP/TQI_SP^{ref}+W_{soot}*[\text{Soot}]/[\text{Soot}]^{ref}+W_{nox}*[Nox]/[Nox]^{ref}+W_{co2}*[\text{CO2}]/[\text{CO2}]^{ref}+W_{HC}*[\text{HC}]/[\text{HC}]^{ref}+W_{CO}*[\text{CO}]/[\text{CO}]^{ref}+W_{noise}*[\text{Noise}]/[\text{Noise}]^{ref}\ \textit{and where:}$$

TQI_SP$^{ref}$ is the targeted indicated torque in Nm;

[Soot]$^{ref}$ is the targeted soot emission value in g/stroke or g/km;

[Nox]$^{ref}$ is the targeted nitrogen oxides emission value in g/stroke or g/km;

[CO2]$^{ref}$ is the targeted carbon dioxide emission value in g/stroke or g/km;

[HC]$^{ref}$ is the targeted unburnt hydrocarbons emission value in g/stroke or g/km;

[CO]$^{ref}$ is the targeted carbon monoxide emission value in g/stroke or g/km;

[Noise]$^{ref}$ is the targeted noise limitation in DbA or bar/s; and/or $W_k$ is a weight proportional to the importance of an objective k relative to the others, For example, if the CO2 emission constrains should be rigorously respected, $W_{CO}2$ should be more important than the other weights by respecting $\Sigma_k W_k=1$ .

11. The method according to claim 2, wherein an engine actuator used to minimize an error of a multi-objective function J for each operating point in the case of modern EMS dedicated to auto ignition engine control are selected from the group consisting of:

the number of injection $Nb_{inj}$ par combustion cycle, $1 \leqq i \leqq Nb_{inj}$ where i is an index for different fuel injections relating to a large number of fuel injection patterns, such as i=1 for a first pre-injection, i=2 for a second pre-injection, etc.;

the quantities injected per elementary injection $MF^i$ with $\Sigma_i MF^i=MF$;

the start of injection $SOI^i$ per elementary injection;

the air path control by the way of the global equivalence ratio Φ because in our case the measured air mass flow, MA, is linked to injected mass flow MF by $\Phi=(MF/MA)*\alpha_{stoich}$;

the global equivalence ratio Φ is set according to the engine load targets and the turbocharger air mass flow limitation for a given operating point; and the EGR rate, $X_{EGR}$=[burnt gases]./[fresh gases] defined as the ratio between burnt gases and fresh gases in the intake manifold.

12. The method according to claim 2, wherein embedded maps for the torque realization TOI related to an engine actuators control according to the aforementioned constrains are then reduced to at least one of:

a 2D look up table with a dependence in N and TQI_SP for $Nb_{inj}$, the number of injection request per combustion cycle;

a 2D look up table with a dependence in N and TQI_SP for $MF^i$, the injected fuel mass request for each elementary injection i and per combustion cycle;

a 2D look up table with dependence in N and TQI_SP for $SOI^i$, the start of injection request for each elementary injection and per combustion cycle;

a 2D look up table with dependence in N and TQI_SP for Φ, the global equivalence ratio request per combustion cycle; and a 2D look up table with dependence in N and TQI_SP for the EGR rate request per combustion cycle.

13. A method for operating auto ignition combustion engines, comprising:

directly linking outputs to an injected fuel mass flow distribution and to an injection timing by taking into account engine out emissions and/or drivability constraints by using an optimization method, and using a global equivalence ratio $\Phi=(MF/MA)/(MF/MA)_{stoich}=(MF/MA)*\alpha_{stoich}$ to adapt an air mass flow via an air path control and turbocharger position control, wherein MA represents an air mass flow, MF represents an injected fuel mass.

14. A method for operating auto ignition combustion engines, comprising:

directly linking outputs to an injected fuel mass flow distribution and to an injection timing by taking into account engine out emissions and/or drivability constraints by using an optimization method, and wherein an overall fuel mass injected in a combustion chamber for lean combustion is burnt during the auto-ignition process with the start of injections SOI being calibrated to compensate the injector response, the auto ignition delay, and the EGR effect on the auto ignition delay, such that the combustion efficiency variation $\eta_{comb}$ is ignored and fixed to $\eta_{comb}=1$, at least for a selected SOI bandwidth that respects engine out emission constrains.

15. A method for operating auto ignition combustion engines, comprising:

directly linking outputs to an injected fuel mass flow distribution and to an injection timing by taking into account engine out emissions and/or drivability constraints by using an optimization method, and wherein a mechanical efficiency $\eta_{mech}$ is used in an embedded software as a 2D look up table depending both on the engine speed N and the engine cooling temperature TCO,$\eta_{mech}=\eta_{mech}(N,TCO)$.

16. A method for operating auto ignition combustion engines, comprising:

directly linking a requested torque set point TQI_SP and an estimation of a torque realization TQI to an injection timing by taking into account engine out emissions and/or drivability constraints by using an optimization method, and determining an optimized torque realization TQI_SP by minimizing an error of a multi-objective function J for overall engine operating points, using the function:

$$J=W_{TQI_SP}*TQI_SP/TQI_SP^{ref}+W_{soot}*[\text{Soot}]/[\text{Soot}]^{ref}+W_{nox}*[Nox]/[Nox]^{ref}+W_{co2}*[\text{CO2}]/[\text{CO2}]^{ref}+W_{HC}*[\text{HC}]/[\text{HC}]^{ref}+W_{CO}*[\text{CO}]/[\text{CO}]^{ref}+W_{noise}*[\text{Noise}]/[\text{Noise}]^{ref}\ \textit{and where:}$$

TQI_SP $^{ref}$ is the targeted indicated torque in Nm;

[Soot]$^{ref}$ is the targeted soot emission value in g/stroke or g/km;

[Nox]$^{ref}$ is the targeted nitrogen oxides emission value in g/stroke or g/km;

[CO2] $^{ref}$ is the targeted carbon dioxide emission value in g/stroke or g/km;

[HC] $^{ref}$ is the targeted unburnt hydrocarbons emission value in g/stroke or g/km;

[CO] $^{ref}$ is the targeted carbon monoxide emission value in g/stroke or g/km;

[Noise] $^{ref}$ is the targeted noise limitation in DbA or bar/s; and $W_k$ is a weight of each respective objective k.

* * * * *